US010125492B2

(12) United States Patent
Tinianov

(10) Patent No.: US 10,125,492 B2
(45) **Date of Patent: *Nov. 13, 2018**

(54) ACOUSTICAL SOUND PROOFING MATERIAL WITH IMPROVED FRACTURE CHARACTERISTICS AND METHODS FOR MANUFACTURING SAME

(71) Applicant: Pacific Coast Building Products, Inc., Rancho Cordova, CA (US)

(72) Inventor: Brandon D. Tinianov, Santa Clara, CA (US)

(73) Assignee: PACIFIC COAST BUILDING PRODUCTS, INC., Rancho Cordova, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/783,165

(22) Filed: Mar. 1, 2013

(65) Prior Publication Data

US 2013/0240291 A1 Sep. 19, 2013

Related U.S. Application Data

(63) Continuation of application No. 11/697,691, filed on Apr. 6, 2007, now Pat. No. 9,388,568.

(51) Int. Cl.
*E04B 1/82* (2006.01)
*E04B 1/84* (2006.01)
(Continued)

(52) U.S. Cl.
CPC ..... *E04B 1/82* (2013.01); *E04B 1/84* (2013.01); *E04B 1/86* (2013.01); *E04B 2/7409* (2013.01);
(Continued)

(58) Field of Classification Search
CPC ..... E04B 1/82; E04B 1/84; E04B 1/86; E04B 2001/8461; E04B 2/7409; Y10T 156/10
(Continued)

(56) References Cited

U.S. PATENT DOCUMENTS 2,811,906 A 11/1957 Chappell
3,160,549 A 12/1964 Caldwell et al.
(Continued)

FOREIGN PATENT DOCUMENTS

CA 2219785 10/1996
EP 1154087 11/2001
(Continued)

OTHER PUBLICATIONS

CertainTeed, "QuietRock 510 Installation Instructions", Jul. 2010, (date accessed Aug. 13, 2014), https://www.certainteed.com/resources/CTG_2823_QR510_Installation_E.pdf.*
(Continued)

*Primary Examiner* — Theodore V Adamos
(74) *Attorney, Agent, or Firm* — Sheppard, Mullin, Richter & Hampton LLP; Daniel Yannuzzi

(57) ABSTRACT

A material for use in building construction (partition, wall, ceiling, floor or door) that exhibits improved acoustical sound proofing and fracture characteristics optimized for efficient installation. The material comprises a laminated structure having as an integral part thereof one or more layers of viscoelastic material which also functions both as a glue and as an energy dissipating layer; and one or more constraining layers, such as gypsum or cement-based panel products modified for easy fracture. In one embodiment, standard paper-faced wallboard, typically gypsum, comprises the external surfaces of the laminated structure with the inner surface of said wallboard being bare with no paper or other material being placed thereon. The resulting struc-
(Continued)

ture improves the attenuation of sound transmitted through the structure while also allowing installation of the sound proofing material as efficiently as the installation of standard material when the sound proofing material is used alone or incorporated into a partition assembly.

15 Claims, 5 Drawing Sheets

(51) Int. Cl.
*E04B 1/86* (2006.01)
*E04B 2/74* (2006.01)

(52) U.S. Cl.
CPC ..... *E04B 2001/8461* (2013.01); *Y10T 156/10* (2015.01)

(58) Field of Classification Search
USPC ..... 52/144, 145, 415, 424, 425, 428, 438, 52/442, 309.1, 309.3–309.5, 309.8, 309.9, 52/309.13, 309.14; 181/206, 207, 290
See application file for complete search history.

(56) References Cited

U.S. PATENT DOCUMENTS 3,215,225 A 11/1965 Kirschner
3,336,710 A 8/1967 Raynes
3,399,104 A 8/1968 Ball, III et al.
3,424,270 A 1/1969 Hartman et al.
3,462,899 A 8/1969 Sherman
3,513,009 A 5/1970 Austin et al.
3,579,941 A 5/1971 Tibbals
3,642,511 A 2/1972 Cohn et al.
3,828,504 A 8/1974 Egerborg et al.
3,960,580 A 6/1976 Stierli et al.
4,003,752 A 1/1977 Osohata et al.
RE29,157 E * 3/1977 Petersen et al. ..... 524/271
4,112,176 A 9/1978 Bailey
4,134,956 A 1/1979 Suzuki et al.
4,156,615 A 5/1979 Cukier et al.
4,174,229 A 11/1979 Boberski et al.
4,347,912 A 9/1982 Flocke et al.
4,375,516 A 3/1983 Barrall
4,474,840 A 10/1984 Adams
4,487,793 A 12/1984 Haines et al.
4,557,970 A 12/1985 Holtrop et al.
4,618,370 A 10/1986 Green et al.
4,642,951 A 2/1987 Mortimer
4,663,224 A * 5/1987 Tabata et al. ..... 442/181
4,678,515 A 7/1987 Green et al.
4,685,259 A 8/1987 Eberhart et al.
4,759,164 A 7/1988 Abendroth et al.
4,778,028 A 10/1988 Staley
4,786,543 A 11/1988 Ferm
4,924,969 A 5/1990 K'Heureux
4,956,321 A 9/1990 Barrall
4,967,530 A 10/1990 Clunn
5,016,413 A 5/1991 Counihan
5,026,593 A 6/1991 O'Brien
5,033,247 A 7/1991 Clunn
5,063,098 A 11/1991 Niwa et al.
5,110,660 A 5/1992 Wolf et al.
5,125,475 A 6/1992 Duchame et al.
5,158,612 A 10/1992 Savoly et al.
5,240,639 A 8/1993 Diez et al.
5,256,223 A 10/1993 Alberts et al.
5,258,585 A 11/1993 Juriga
5,334,806 A 8/1994 Avery
5,342,465 A 8/1994 Bronowicki et al.
5,368,914 A 11/1994 Barrett
5,439,735 A 8/1995 Jamison
5,473,122 A 12/1995 Kodiyalam et al.
5,502,931 A 4/1996 Munir
5,601,888 A * 2/1997 Fowler ..... 428/34
5,603,192 A 2/1997 Dickson
5,629,503 A 5/1997 Thomasen
5,643,666 A 7/1997 Eckart et al.
5,664,397 A 9/1997 Holz
5,691,037 A 11/1997 McCutcheon et al.
5,695,867 A 12/1997 Saitoh et al.
5,768,841 A 6/1998 Swartz et al.
5,824,973 A 10/1998 Haines et al.
5,867,957 A 2/1999 Holtrop
5,910,082 A 6/1999 Bender et al.
5,945,208 A 8/1999 Richards et al.
5,954,497 A 9/1999 Cloud et al.
6,077,613 A 6/2000 Gaffigan
6,123,171 A 9/2000 McNett et al.
6,133,172 A 10/2000 Sevenish et al.
6,213,252 B1 4/2001 Ducharme
6,240,704 B1 6/2001 Porter
6,266,427 B1 7/2001 Mathur
6,286,280 B1 9/2001 Fahmy et al.
6,290,021 B1 9/2001 Standgaard
6,309,985 B1 10/2001 Virnelson et al.
6,342,284 B1 1/2002 Yu
6,381,196 B1 4/2002 Hein et al.
6,389,771 B1 5/2002 Moller
6,391,958 B1 * 5/2002 Luongo ..... 524/423
6,443,256 B1 9/2002 Baig
6,632,550 B1 10/2003 Yu
6,676,744 B2 1/2004 Merkley et al.
6,699,426 B1 3/2004 Burke
6,715,241 B2 4/2004 Gelin et al.
6,758,305 B2 7/2004 Gelin et al.
6,790,520 B1 9/2004 Todd et al.
6,800,161 B2 10/2004 Takigawa
6,803,110 B2 10/2004 Drees et al.
6,815,049 B2 11/2004 Veramasuneni
6,822,033 B2 11/2004 Yu
6,825,137 B2 11/2004 Fu et al.
6,877,585 B2 4/2005 Tinianov
6,913,667 B2 7/2005 Nudo et al.
6,920,723 B2 7/2005 Downey
6,941,720 B2 9/2005 Deford et al.
7,041,377 B2 5/2006 Miura et al.
7,068,033 B2 6/2006 Sellers et al.
7,181,891 B2 2/2007 Surace et al.
7,197,855 B2 4/2007 Della pepa
7,255,907 B2 8/2007 Feigin et al.
7,745,005 B2 * 6/2010 Tinianov ..... 428/411.1
7,799,410 B2 * 9/2010 Tinianov ..... 428/212
7,883,763 B2 * 2/2011 Tinianov ..... 428/201
8,424,251 B2 * 4/2013 Tinianov ..... 52/144
2004/0016184 A1 1/2004 Huebsch et al.
2004/0168853 A1 9/2004 Gunasekera et al.
2004/0214008 A1 10/2004 Dobrusky et al.
2005/0103568 A1 5/2005 Sapoval et al.
2005/0263925 A1 * 12/2005 Heseltine et al. ..... 264/109
2006/0048682 A1 3/2006 Wagh et al.
2006/0057345 A1 3/2006 Surace et al.
2006/0059806 A1 3/2006 Gosling et al.
2006/0108175 A1 5/2006 Surace et al.
2007/0094950 A1 5/2007 Surace et al.
2007/0107350 A1 5/2007 Surace et al.

FOREIGN PATENT DOCUMENTS

JP 09-203153 8/1997
WO WO 96/34261 10/1996
WO WO 97/19033 5/1997
WO WO 00/24690 5/2000

OTHER PUBLICATIONS

"Damping of plate flexural vibrations by means of viscoelastic laminae" by D. Ross, E.E. Ungar, and E.M. Kerwin—Structural Damping, Section III, ASME, 1959, New York (41 pages).
A Guide to Airborne, Impact, and Structureborne Noise Control in Multifamily Dwellings, U.S. Department of Housing and Urban

(56) References Cited

OTHER PUBLICATIONS

Development, Prepared for the National Bureau of Standards, Washington, D.C., Jan. 1963 (5 pages).
A Study of Techniques to Increase the Sound of Insulation of Building Elements, Wyle Laboratories, Prepared for Dept. of Housing and Urban Development, Jun. 1973 (16 pages).
A Study of Techniques to Increase the Sound of Insulation of Building Elements, Wyle Laboratories, Prepared for Dept. of Housing and Urban Development, Jun. 1973 (12 pages).
Architectural Acoustics, M. David Egan, J. Ross Publishing (Reprint 2007) p. 211; originally published McGraw-Hill, 1998 (5 pages).
Architectural Acoustics, Principles and Practice, John Wiley & sons, 1992, Cavanaugh, Williams J. and Wilkes, Joseph A. (editors) (332 pages).
ASC WallDamp materials from Acoustic Sciences Corporation http://web.archive.org/web/20021013031149/www.asc-soundproof.com/index-walldamp . . . May 18, 2007 (21 pages).
Barbara C. Lippiatt, National Institute of Standards and Technology. BEES 3.0, "Building for Environmental and Economic Sustainability Technical Manual and User Guide", Oct. 2002, (198 pages).
Chamber Science and Technology Dictionary, by Professor Peter M.B. Walker, W & R Chambers Ltd and Cambridge University Press, 1988 (3 pages).
dB-Ply materials Sound Reducing Panels from Greenwood Forest Products, Inc., Apr. 24, 1997 (9 pages).
Dictionary of Architecture & Construction 2200 illustrations, Third Edition, Edited by Cyril M. Harris, Professor Emeritus of Architecture Columbia University, McGraw-Hill, 2000 (7 pages).
Dictionary of Engineering Materials, Harald Keller, Uwe Erb, Wiley-Interscience by John Wiley & Sons, Inc. 2004 (4 pages).
Dynamat materials http://web.archive.org/web/20010525113753/www.admteschusa.com/Dynamat.htm Jun. 12, 2007, ADM Tech—Dynamic Control (15 pages).
English Language Abstract, JP Patent First Publication No. 09-203153, Aug. 5, 1997, (2 pages).
Field Sound Insulation Evaluation of Load-Beating Sandwich Panels for Housing, Final Report, Prepared by Robert E. Jones, Forest Products Laboratory, Forest Serv., U.S. Dept. of Agriculture, Aug. 1975 (53 pgs.).
Handbook of Acoustical Measurements and Noise Control, Edited by Cyril Harris, Chapter 32; Structureborne Sound Isolation, Chapter33; Noise Control in Buildings, McGraw-Hill, Inc. 1991, (36 pages).
Hastings, Mardi C.; Godfrey, Richard; Babcock, G. Madison, Application of Small Structures and Materials 1996: Passive Damping and Isolation (7 pages).
IES 2000 Dampening and Visocelastic Membranes (Jul. 2, 2003) Atlanta.com/product (pp. 1-6).
Nashif, Ahid D.; Jones, David I. G.; Henderson, John P., Vibration Damping, pp. 290-305, John Wiley & Sons, 1985 (18 pages).
Noise and Vibration Control, Chapter Fourteen, Damping of Panels, Ungar, Eric E., pp. 434-473, McGraw Hill, 1971, Beranek, Leo L. (editor) (7 pages).
Noise and Vibration Control, Engineering, Principles and Application, pp. 466-479, John Wiley & Sons, 1992 Beranek, Leo L. and Ver, Istvan L. (editors) (9 pages).
Noise and Vibration Control, Revised Edition, pp. 306-315, Institute of Noise Control Engineering, 1988, Beranek, Leo L. (editor) (9 pages).
Noise Killer: Pro Damping Compound Materials http://www.tnt-audio.com/clinica/noise.html May 18, 2007, 1998 (3 pages).
Non-Final Office Action dated May 3, 2013 from related U.S. Appl. No. 11/697,691, 15 pages.
Nordisk Akustik A/S materials, http://web.archive.org/web/200206240933724/www.nordisk-akustik.dk/html_uk/prod03.ht . . . Jun. 11, 2007 (4 pages).
Noxon, Arthur M., the Chain Is as Strong as Its Weakest Link, An article written for the first Hong Kong HiFi Show, 1993, Translated and Published in Chinese, http://www.acousticsciences.com/articles/chain.htm (7 pages).
Patent Examination Report No. 1 dated Apr. 24, 2013 from related Australian Application No. 2008237205, 5 pages.
Quiet Lightweight Floor Systems, Reprint from Sound and Vibration Magazine, Jul. 1992, by David A. Harris, Building & Acoustic Design Consultants (7 pages).
Ross Marty, CPed, CO, "Data support use of P-Cell in diabetic footwear", CMP Media LLC, Mar. 1, 2003.
Sound Studio Construction on a Budget, F. Alton Everest, McGraw-Hill, 1997 (7 pages).
Takada, et al., Effect in Reducing Floor Impact Noise of Recycled Paper Damper Members, Bulletin of Tokyo Metropolitan Industrial Technology Research Institute, No. 2 (1999) [certified English translation] (13 pages).
Transmission Loss of Leaded Building Materials, Pail B. Ostergaard, Richmond L. Cardinell, and Lewis S. Goodfriend, The Journal of the Acoustical Society of America, vol. 35, No. 6, Jun. 1963 (7 pages).
Unified Facilities Criteria (UFC) Noise and Vibration Control, UFC 3-450-01. May 15, 200, Department of Defense (156 pages).
United States Gypsum, Architectural and Construction Services, Design Data for Acousticians, Feb. 1986 (4 pages).
Van Vuure, A.W.; Verpoest, I., Ko, F.K., Sandwich-Fabric Panels as Spacers in a Constrained Layer Structural Damping Application, Composites Part B 32 (2001) 11-19, Elsevier Science Ltd. (9 pages).
Vandersall, H.L., "Intumescent Coating Systems, Their development and Chemistry" J. Fire & Flammability, vol. 2 (Apr. 1971) pp. 97-140 (45 pages).
Waybackmachine search results for Jan. 1, 1996-Jun. 12, 2007 (1 page).
Waybackmachine search results for Jan. 1, 1996-May 3, 2006 (1 page).
Wood Handbook/Wood as an Engineering Material, United States Department of Agriculture, Forest Service, General Technical Report FPL-FGTR-113, Mar. 1999 (24 pages).

* cited by examiner

ASTM C473 Flexural strength test results for a laminated wallboard

| Sample Number | Sample Description | Peak Load at Fracture (lbf) |
|---|---|---|
| H1 | ½ inch thick laminated gyp panel optimized for fracture | 24.1 |
| H2 | ½ inch thick laminated gyp panel optimized for fracture | 21.7 |
| H3 | ½ inch thick laminated gyp panel optimized for fracture | 19.8 |
| H4 | ½ inch thick laminated gyp panel optimized for fracture | 22.4 |
| Average | | **22.0** |
| Standard Deviation | | **1.82** |

FIG. 3

ASTM C473 flexural strength test results for various wallboard types and conditions

| Series Identification | Sample Description | Average Peak Load at Fracture (lbf) | Standard Deviation |
|---|---|---|---|
| A1 - A4 | 5/8 inch thick gypsum panel | 204 | 2.99 |
| B1 - B4 | ½ inch thick gypsum panel | 147 | 3.10 |
| C1 – C4 | ½ inch thick QuietRock 510 laminated gypsum panel | 164 | 4.90 |
| D1 – D4 | ½ inch thick laminated gyp panel optimized for fracture | 111 | 8.34 |
| E1 – E4 | 5/8 inch thick gypsum panel, scored | 46.3 | 4.65 |
| F1 – F4 | ½ inch thick gypsum panel, scored | 15.0 | 0.50 |
| G1 – G4 | ½ inch thick QuietRock 510 laminated gypsum panel, scored | 84.5 | 3.30 |
| H1 – H4 | ½ inch thick laminated gyp panel optimized for fracture, scored | 22.0 | 1.82 |

FIG. 4

ACOUSTICAL SOUND PROOFING MATERIAL WITH IMPROVED FRACTURE CHARACTERISTICS AND METHODS FOR MANUFACTURING SAME

CROSS REFERENCE TO RELATED APPLICATION

This application is a continuation of U.S. application Ser. No. 11/697,691 filed Apr. 6, 2007, which is hereby incorporated herein by reference in its entirety.

BACKGROUND

Noise control constitutes a rapidly growing economic and public policy concern for the construction industry. Areas with high acoustical isolation (commonly referred to as 'soundproofed') are requested and required for a variety of purposes. Apartments, condominiums, hotels, schools and hospitals all require walls, ceilings and floors that are specifically designed to reduce the transmission of sound in order to minimize or eliminate the disruption to people in adjacent rooms. Soundproofing is particularly important in buildings adjacent to public transportation including highways, airports and railroad lines. Additionally, theaters and home theaters, music practice rooms, recording studios and others require increased noise abatement for acceptable listening levels. Likewise, hospitals and general healthcare facilities have begun to recognize acoustical comfort as an important part of a patient's recovery time. One measure of the severity of multi-party residential and commercial noise control issues is the widespread emergence of model building codes and design guidelines that specify minimum Sound Transmission Class (STC) ratings for specific wall structures within a building. Another measure is the broad emergence of litigation between homeowners and builders over the issue of unacceptable noise levels. To the detriment of the U.S. economy, both problems have resulted in major builders refusing to build homes, condos and apartments in certain municipalities; and in cancellation of liability insurance for builders.

Various construction techniques and products have emerged to address the problem of noise control, such as: replacement of wooden framing studs with light gauge steel studs; alternative framing techniques such as staggered-stud and double-stud construction; additional gypsum drywall layers; the addition of resilient channels to offset and isolate drywall panels from framing studs; the addition of mass-loaded vinyl barriers; cellulose-based sound board; and the use of cellulose and fiberglass batt insulation in walls not requiring thermal control. All of these changes help reduce the noise transmission but not to such an extent that certain disturbing noises (e.g., those with significant low frequency content or high sound pressure levels) in a given room are prevented from being transmitted to a room designed for privacy or comfort. The noise may come from rooms above or below the occupied space, or from an outdoor noise source. In fact, several of the above named methods only offer a three to six decibel improvement in acoustical performance over that of standard construction techniques with no regard to acoustical isolation. Such a small improvement represents a just noticeable difference, not a soundproofing solution. A second concern with the above named techniques is that each involves the burden of either additional (sometimes costly) construction materials or extra labor expense due to complicated designs and additional assembly steps.

More recently, an alternative building noise control product has been introduced to the market in the form of a laminated damped drywall panel as disclosed in U.S. Pat. No. 7,181,891. That panel replaces a traditional drywall layer and eliminates the need for additional materials such as resilient channels, mass loaded vinyl barriers, additional stud framing, and additional layers of drywall. The resulting system offers excellent acoustical performance improvements of up to 15 decibels in some cases. However, the panel cannot be cut by scribing and breaking. Rather than using a box cutter or utility knife to score the panel for fracture by hand, the panels must be scored multiple times and broken with great force over the edge of a table or workbench. Often times, the quality of the resulting break (in terms of accuracy of placement and overall straightness) is poor. The reason for the additional force required to fracture the laminated panel is because the component gypsum layers have a liner back paper (or liner fiberglass nonwoven) that has a high tensile strength. Tests have shown that scored panels of this type require approximately 85 pounds of force to fracture versus the 15 pounds required to break scored ½ inch thick standard gypsum wallboard and the 46 pounds of force required to break scored ⅝ inch thick type X gypsum wallboard. This internal layer (or layers, in some cases) must be broken under tension via considerable bending force during a typical score and snap operation.

In many cases, the tradesman is forced to cut each panel with a power tool such as a circular saw or a rotary cutting tool to ensure a straight cut and a high quality installation. This adds time and labor costs to the panel installation and generates copious amounts of dust which act as a nuisance to the laborers and adds even more installation expense in the form of jobsite clean up.

A figure of merit for the sound reducing qualities of a material or method of construction is the material or wall assembly's Sound Transmission Class (STC). The STC rating is a classification which is used in the architectural field to rate partitions, doors and windows for their effectiveness in blocking sound. The rating assigned to a particular partition design as a result of acoustical testing represents a best fit type of approach to a curve that establishes the STC value. The test is conducted in such a way as to make it independent of the test environment and yields a number for the partition only and not its surrounding structure or environment. The measurement methods that determine an STC rating are defined by the American Society of Testing and Materials (ASTM). They are ASTM E 90, "Standard Test Method Laboratory Measurement of Airborne Sound Transmission Loss of Building Partitions and Elements," and ASTM E413 "Classification for Sound Insulation," used to calculate STC ratings from the sound transmission loss data for a given structure. These standards are available on the Internet at www.astm.org.

A second figure of merit for the physical characteristics of construction panels is the material's flexural strength. This refers to the panel's ability to resist breaking when a force is applied to the center of a simply supported panel. Values of flexural strength are given in pounds of force (lbf) or Newtons (N). The measurement technique used to establish the flexural strength of gypsum wallboard or similar construction panels is ASTM C 473 "Standard Test Methods for the Physical Testing of Gypsum Panel Products". This standard is available on the Internet at www.astm.org.

The desired flexural strength of a panel is dependant upon the situation. For a pristine panel, a high flexural strength is desirable since it allows for easy transportation and handling without panel breakage. However, when the panel is scored by the tradesman (for example, with a utility knife) for fitting and installation, a low flexural strength is desirable. In that case, a low value indicates that the scored panel may be easily fractured by hand without excessive force.

Accordingly, what is needed is a new material and a new method of construction to reduce the transmission of sound from a given room to an adjacent area while simultaneously minimizing the materials required and the cost of installation labor during construction.

SUMMARY

In accordance with the present invention, a new laminar structure and associated manufacturing process are disclosed which significantly improve both the material's installation efficiency and the ability of a wall, ceiling, floor or door to reduce the transmission of sound from one architectural space (e.g. room) to an adjacent architectural space, or from the exterior to the interior of an architectural space (e.g. room), or from the interior to the exterior of an architectural space.

The material comprises a lamination of several different materials. In accordance with one embodiment, a laminar substitute for drywall comprises a sandwich of two outer layers of selected thickness gypsum board, each lacking the standard liner back paper, which are glued to each other using a sound dissipating adhesive wherein the sound dissipating adhesive is applied over all of the interior surfaces of the two outer layers. In one embodiment, the glue layer is a specially formulated QuietGlue™, which is a viscoelastic material, of a specific thickness. Formed on the interior surfaces of the two gypsum boards, the glue layer is about 1/32 inch thick. In one instance, a 4 foot×8 foot panel constructed using a 1/32 inch thick layer of glue has a total thickness of approximately ½ inches and has a scored flexural strength of 22 pounds force and an STC value of approximately 38. A double-sided wall structure constructed using single wood studs, R13 fiberglass batts in the stud cavity, and the laminated panel screwed to each side provides an STC value of approximately 49. The result is a reduction in noise transmitted through the wall structure of approximately 15 decibels compared to the same structure using common (untreated) gypsum boards of equivalent mass and thickness.

BRIEF DESCRIPTION OF THE DRAWINGS

This invention will be more fully understood in light of the following drawings taken together with the following detailed description.

FIG. 3 shows flexural strength results for one sample embodiment of a laminar material constructed in accordance with the present invention.

FIG. 4 shows flexural strength results for several examples of drywall materials including typical drywall, laminated panels in current use, and the present invention.

DESCRIPTION OF SOME EMBODIMENTS

The following detailed description is meant to be exemplary only and not limiting. Other embodiments of this invention, such as the number, type, thickness, dimensions, area, shape, and placement order of both external and internal layer materials, will be obvious to those skilled in the art in view of this description.

The process for creating laminar panels in accordance with the present invention takes into account many factors: exact chemical composition of the glue; glue application process; pressing process; and drying and dehumidification process.

Figure 1:
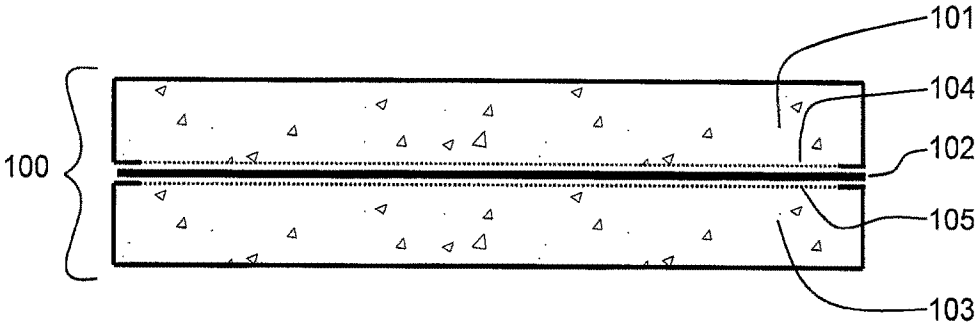
FIG. 1 shows a laminar structure fabricated in accordance with this invention for reducing the transmission of sound through the material while providing superior fracture characteristics.

FIG. 1 shows the laminar structure of one embodiment of this invention. In FIG. 1, the layers in the structure will be described from top to bottom with the structure oriented horizontally as shown. It should be understood, however, that the laminar structure of this invention will be oriented vertically when placed on vertical walls, doors or other vertical partitions, as well as horizontally or even at an angle when placed on ceilings and floors. Therefore, the reference to top and bottom layers is to be understood to refer only to these layers as oriented in FIG. 1 and not in the context of the vertical use of this structure. In FIG. 1, the assembly numerated as 100 refers to an entire laminated panel constructed in accordance with this invention. A top layer 101 is made up of a paper or fiberglass-faced gypsum material and in one embodiment is ¼ inch thick. In one embodiment sixty (60) pound paper eighteen (18) mils thick is used. The resulting panel is ¼ inch plus eighteen (18) mils thick. Of course, many other combinations and thicknesses can be used for any of the layers as desired. The thicknesses are limited only by the acoustical attenuation (i.e., STC rating) desired for the resulting laminar structure and by the weight of the resulting structure which will limit the ability of workers to install the laminated panel on walls, ceilings, floors and doors for its intended use.

The gypsum board in top layer 101 typically is fabricated using standard well-known techniques and thus the method for fabricating the gypsum board will not be described. Next, the bottom face of gypsum layer 101 is an unfaced (without paper or fiberglass liner) interior surface 104. In other embodiments, surface 104 may be faced with a thin film or veil with a very low tensile strength. In one embodiment this thin film or veil can be a single use healthcare fabric as described more completely below in paragraph 21. Applied to surface 104 is a layer of glue 102 called "QuietGlue™. Glue 102, made of a viscoelastic polymer, has the property that the kinetic energy in the sound which interacts with the glue, when constrained by surrounding layers, will be significantly dissipated by the glue thereby reducing the sound's total energy across a broad frequency spectrum, and thus the sound energy which will transmit through the resulting laminar structure. Typically, this glue 102 is made of the materials as set forth in TABLE 1, although other glues having similar characteristics to those set forth directly below TABLE 1 can also be used in this invention.

TABLE 1

| Fire-Enhanced (FE) Quiet Glue ™ Chemical Makeup | | | |
|---|---|---|---|
| | WEIGHT % | | |
| COMPONENTS | Min | Max | Preferred |
| acrylate polymer | 30 | 70 | 41 |
| ethyl acrylate, methacrylic acid, polymer with ethyl-2-propenoate | 0 | 3.0 | 0.3 |
| hydrophobic silica | 0 | 1.0 | 0.2 |
| paraffin oil | 0 | 3.0 | 1.5 |
| silicon dioxide | 0 | 1.0 | 0.1 |
| sodium carbonate | 0 | 3.0 | 0.6 |
| stearic acid, aluminum salt | 0 | 1.0 | 0.1 |
| surfactant | 0 | 2.0 | 0.6 |
| rosin ester | 0 | 20 | 7 |
| Zinc Borate | 0 | 25 | 12 |
| Melamine Phosphate | 0 | 10 | 6 |
| Ammonium Polyphosphate | 0 | 10 | 6 |
| Hexahydroxy methyl ethane | 0 | 5.0 | 1.5 |
| CI Pigment Red Dispersion | 0 | 1.0 | 0.02 |
| water | 10 | 40 | 23 |
| 2-Pyridinethiol, 1-oxide, sodium salt | 0 | 3.0 | 1 |

The preferred formulation is but one example of a viscoelastic glue. Other formulations may be used to achieve similar results and the range given is an example of successful formulations investigated here.

The physical solid-state characteristics of QuietGlue™ include:

1) a broad glass transition temperature below room temperature;
2) mechanical response typical of a rubber (i.e., elongation at break, low elastic modulus);
3) strong peel strength at room temperature;
4) weak shear strength at room temperature;
6) does not dissolve in water (swells poorly); and
7) peels off the substrate easily at temperature of dry ice.

QuietGlue may be obtained from Serious Materials, 1259 Elko Drive, Sunnyvale, Calif. 94089.

Gypsum board layer 103 is placed on the bottom of the structure and carefully pressed in a controlled manner with respect to uniform pressure (pounds per square inch), temperature and time. The top face of gypsum layer 103 is an unfaced (without paper or fiberglass liner) interior surface 105. In other embodiments, surface 105 may be faced with a thin film or veil with a very low tensile strength. The maximum very low tensile strength for the thin film or veil is approximately six (6) psi but the preferred very low tensile strength for this material is as low as approximately one (1) psi. In one embodiment this thin film can be a fabric such as a single use healthcare fabric as described more completely in paragraph 21. Such fabrics are typically used for surgical drapes and gowns.

Finally, the assembly is subjected to dehumidification and drying to allow the panels to dry, typically for forty-eight (48) hours.

In one embodiment of this invention, the glue 102, when spread over the bottom of top layer 101, is subject to a gas flow for about forty-five seconds to partially dry the glue. The gas can be heated, in which case the flow time may be reduced. The glue 102, when originally spread out over any material to which it is being applied, is liquid. By partially drying out the glue 102, either by air drying for a selected time or by providing a gas flow over the surface of the glue, the glue 102 becomes a pressure sensitive adhesive, much like the glue on a tape. The second panel, for example the bottom layer 103, is then placed over the glue 102 and pressed against the material beneath the glue 102 (as in the example of FIG. 1, top layer 101) for a selected time at a selected pressure. The gas flowing over the glue 102 can be, for example, air or dry nitrogen. The gas dehumidifies the glue 102, improving manufacturing throughput compared to the pressing process described previously wherein the glue 102 is not dried for an appreciable time prior to placing layer 103 in place.

Figure 2:
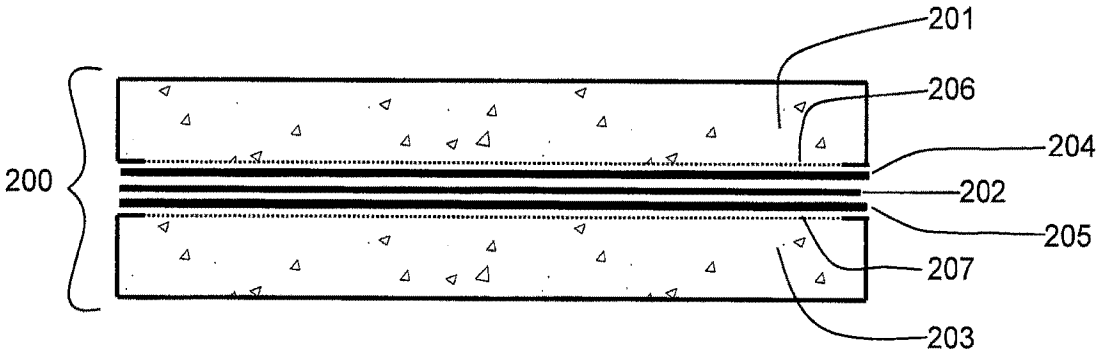
FIG. 2 shows a second embodiment of a laminated structure containing five (5) layers of material capable of significantly reducing the transmission of sound through the material while providing superior fracture characteristics.

In FIG. 2, two external layers of gypsum board 201 and 203 have on their interior faces unfaced surfaces 206 and 207, respectively. Attached to these are glue layers 204 and 205 respectively. Between the two glue layers 204 and 205 is a constraining layer 202 made up of polyester, non-woven fiber, or another low tensile strength material suitable for the application. The tensile strength of this constraining layer can be a maximum of approximately ten (10) psi but preferably is from approximately one (1) to three (3) psi.

Examples of materials for the constraining layer 202 include polyester non-wovens, fiberglass non-woven sheets, cellulosic nonwovens, or similar products. The tensile strength of these materials varies with the length of the constituent fibers and the strength of the fiber/binder bond. Those with shorter fibers and weaker bond strengths have lower tensile strengths. A good example of such materials are the plastic-coated cellulosic nonwoven materials commonly used as single use healthcare fabrics, known for their poor tensile strengths. Single use healthcare fabrics are available from the 3M Corporation of St. Paul, Minn., DuPont of Wilmington, Del. and Ahlstrom of Helsinki, Finland. The preferred maximum very low tensile strength for these materials is approximately six (6) psi but the preferred very low tensile strength for these materials is approximately one (1) psi. The weight of these materials can vary from a high of approximately four (4) ounces per square yard down to a preferred weight of approximately eight tenths (0.8) of an ounce per square yard. Alternate materials can be of any type and any appropriate thickness with the condition that they have acceptably low tensile strength properties. In the example of FIG. 2, the constraining material 202 approximate covers the same area as the glue 204 and 205 to which it is applied.

FIG. 3 shows flexural strength test results for an embodiment wherein the interior surfaces (104 and 105) the gypsum sheets 101, 103 do not have an additional facing material such as paper. The sample tested was constructed consistent with FIG. 1, and had dimensions of 0.3 m by 0.41 m (12 inches by 16 inches) and a total thickness of 13 mm (0.5 inch). A three point bending load was applied to the sample according to ASTM test method C 473, bending test method B. The measured flexural strength was 22 pounds force.

The flexural strength value of the finished laminate 100 significantly decreases with the elimination of the paper facings at surfaces 104 and 105. FIG. 4 illustrates the relationship of two laminate embodiments and typical gypsum wallboard materials. As seen in FIG. 4, the currently available laminated panels G1 to G4 (QuietRock 510) have an average flexural strength of 85 pounds force when scored.

In comparison, scored typical prior art gypsum sheets (F1 to F4 and E1 to E4) with interior paper faced surfaces, have an average flexural strength of 15 pounds force for ½ inch thick and 46 pounds force for ⅝ inch thick respectively. These prior art laminated panels can be scored and fractured in the standard manner used in construction but lack the acoustic properties of the structures described herein. The other prior art structures shown in FIG. 4 (A1-A4 to D1-D4 and G1-G4) have an average peak load at fracture above fifty pounds force and thus are unacceptable materials for traditional fracture methods during installation. Of these prior art materials, QuietRock ®(G1-G4) has improved sound attenuation properties but can not be scored and fractured using traditional scoring and breaking methods. The present invention (represented by H1 to H4) has a scored flexural strength of 22 pounds force as shown in FIGS. 3 and 4. and thus can be scored and fractured in the standard manner used in construction while at the same time providing an enhanced acoustical attenuation of sound compared to the prior art structures (except QuietRock).

Figure 5:
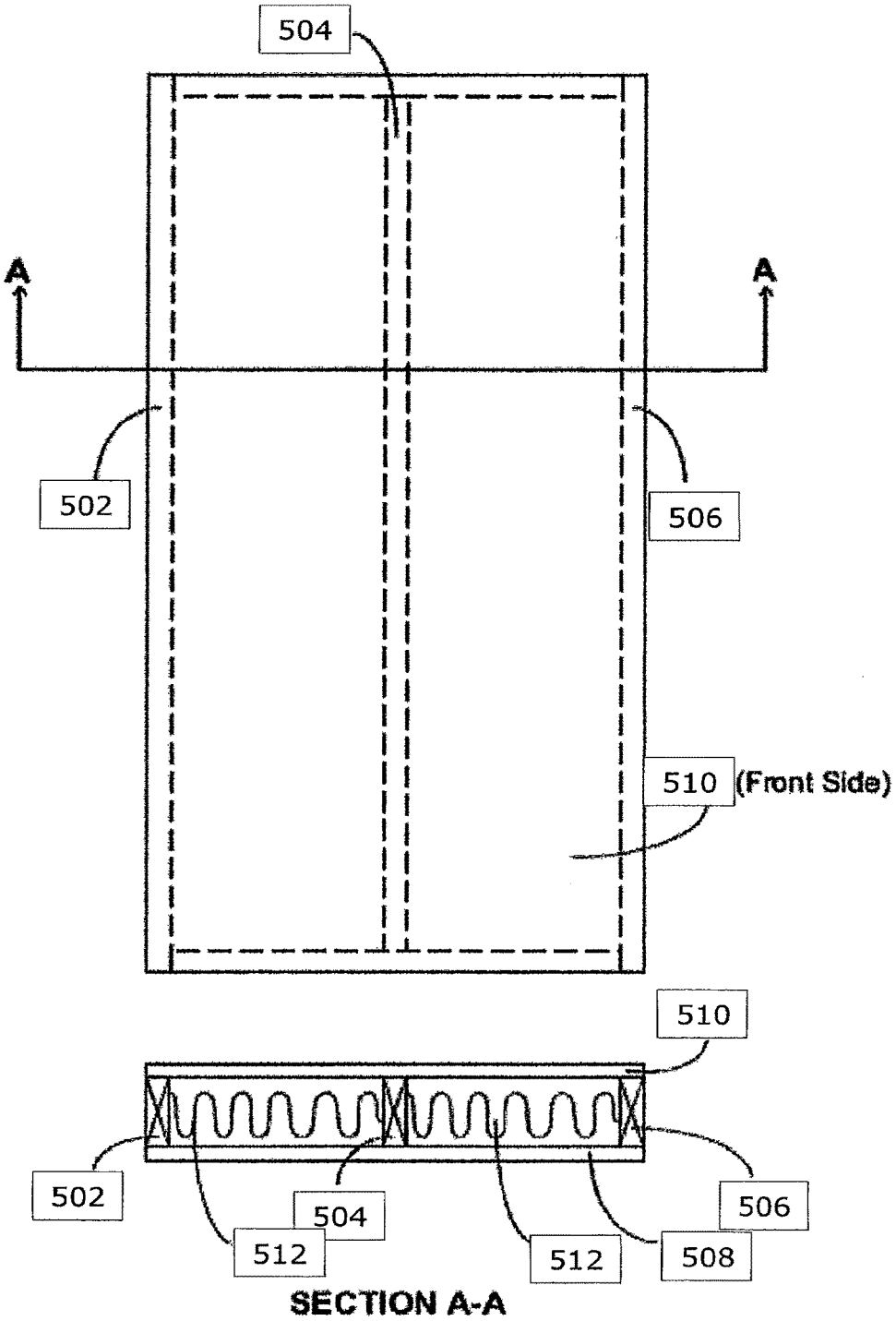
FIG. 5 shows a wall structure wherein one element of the structure comprises a laminar panel constructed in accordance with the present invention.
Figure 6:
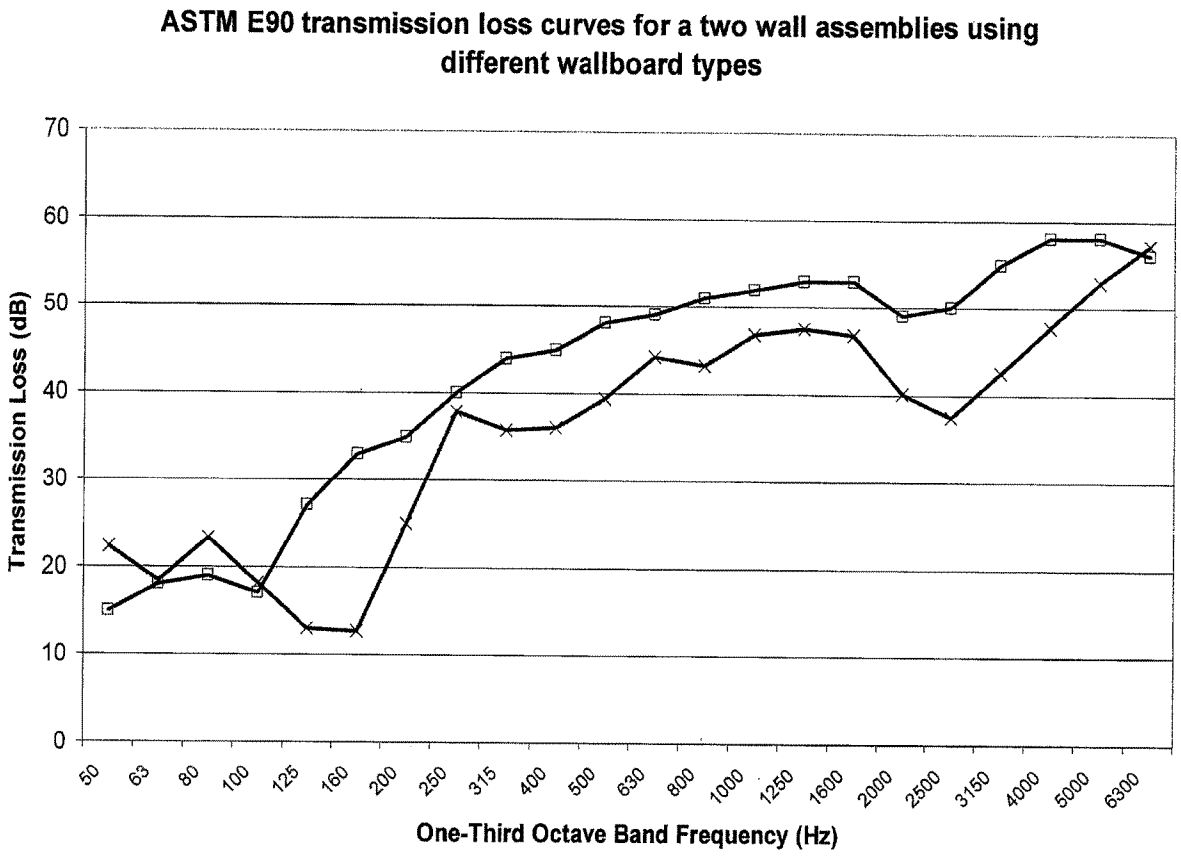
FIG. 6 graphically shows detailed results data of sound attenuation tests for an example embodiment of this invention and a typical wall of similar weight and physical dimensions.

FIG. 5 is an example of a wall structure comprising a laminated panel 508 constructed in accordance with the present invention (i.e., laminate 100 as shown in FIG. 1); wood studs 502, 504, and 506; batt-type insulation 512; and a ⅝ inch sheet of standard gypsum drywall 510, with their relationship shown in Section A-A. FIG. 6 shows the results of sound testing for a structure as in FIG. 5, wherein the panel 508 is constructed as shown in FIG. 1. Sound attenuation value (STC number) of the structure is an STC of 49. It is known to those practicing in this field that a similar configuration with standard ⅝ inch drywall on both sides of standard 2×4 construction yields an STC of approximately 34. Accordingly, this invention yields a 15 STC point improvement over standard drywall in this particular construction.

In fabricating the structure of FIG. 1, the glue 104 is first applied in a prescribed manner in a selected pattern, typically to 1/32 inch thickness, although other thicknesses can be used if desired, onto the top layer 101. The bottom layer 103 is placed over the top layer 101. Depending on the drying and dehumidification techniques deployed, anywhere from five minutes to thirty hours are required to totally dry the glue in the case that the glue is water-based. A solvent-based viscoelastic glue can be substituted for the water-based glue. The solvent-based glue requires a drying time of about five (5) minutes in air at room temperature.

In fabricating the structure of FIG. 2, the method is similar to that described for the structure of FIG. 1. However, before the bottom layer 203 is applied (bottom layer 203 corresponds to bottom layer 103 in FIG. 1) the constraining material 202 is placed over the glue 204. A second layer of glue 205 is applied to the surface of the constraining material 202 on the side of the constraining material 202 that is facing away from the top layer 201. In one embodiment the glue layer 205 is applied to the interior side of bottom layer 203 instead of being applied to layer 202. The bottom layer 203 is placed over the stack of layers 201, 204, 202 and 205. The resulting structure is dried in a prescribed manner under a pressure of approximately two to five pounds per square inch, depending on the exact requirements of each assembly, although other pressures may be used as desired.

Accordingly, the laminated structures of this invention provide a significant improvement in the sound transmission class number associated with the structures and thus reduce significantly the sound transmitted from one room to adjacent rooms while simultaneously providing for traditional scoring and hand fracture during installation.

The dimensions given for each material in the laminated structures of this invention can be varied as desired to control cost, overall thickness, weight, anticipated moisture and temperature control requirements, and STC results. The described embodiments and their dimensions are illustrative only and not limiting. Other materials than gypsum can be used for one or both of the external layers of the laminated structures shown in FIGS. 1 and 2. For example, the layer 103 of the laminated structure 100 shown in FIG. 1 and the layer 203 of the laminated structure 200 shown in FIG. 2 can be formed of cement or of a cement-based material in a well known manner. The cement-based material can include calcium silicate, magnesium oxide and/or phosphate or combinations thereof.

Other embodiments of this invention will be obvious in view of the above description.

What is claimed is:

1. A laminated building structure, comprising:

a first gypsum board having two surfaces, said two surfaces including a first outer clad surface and a first inner unclad surface, wherein the entire inner surface of the first gypsum board is unclad;

a first layer of viscoelastic glue placed directly on the first inner unclad surface; and a second gypsum board located proximate to said first layer of viscoelastic glue, said second gypsum board having two surfaces, said two surfaces including a second outer clad surface and a second inner unclad surface, wherein the entire inner surface of the second gypsum board is unclad.

2. The structure of claim 1, wherein said second gypsum board directly contacts said first layer of viscoelastic glue.

3. The structure of claim 1, wherein said structure is adapted for use in walls, ceilings, floors or other building partitions to attenuate sound.

4. The structure of claim 1, wherein said first outer clad surface is paper.

5. The structure of claim 1, wherein said first outer clad surface is nonwoven fiberglass.

6. The structure of claim 1, further including:

a constraining layer formed from a low tensile strength material placed directly on said first layer of viscoelastic glue, said constraining layer having a first constraining layer surface in contact with said first layer of viscoelastic glue and a second constraining layer surface; and a second layer of viscoelastic glue located directly on the second constraining layer surface, wherein said second gypsum board directly contacts said second layer of viscoelastic glue.

7. The structure of claim 1, wherein said structure has a scored flexural strength of less than about 50 pounds force when one of the first or second outer clad surfaces is scored.

8. The structure of claim 7, wherein said structure has a scored flexural strength of about 22 pounds force when one of the first or second outer clad surfaces is scored.

9. The structure of claim 1, wherein said structure has a Sound Transmission Class ("STC") value of greater than about 34.

10. The structure of claim 9, wherein said structure has an STC of about 49.

11. The structure of claim 1 wherein the viscoelastic glue is a fire enhanced glue comprising up to 25% of a zinc borate compound by weight.

12. A laminated, sound-attenuating structure, comprising:

a gypsum board having two surfaces, said two surfaces including an outer paper-clad surface and an inner unclad surface, wherein the entire inner surface of the gypsum board is unclad;

a first layer of viscoelastic glue located directly on the inner unclad surface; and a cement-based board located proximate said first layer of viscoelastic glue, said cement-based board having two surfaces, said two surfaces including an outer cement surface and an inner cement surface.

13. The structure of claim 12, wherein the cement-based board includes calcium silicate, magnesium oxide, or a phosphate.

14. The structure of claim 12, further comprising:

a low tensile strength constraining layer located over said first layer of viscoelastic glue, said constraining layer having two surfaces, including a first constraining layer surface in direct contact with said first layer of viscoelastic glue and a second constraining layer surface; and a second layer of viscoelastic glue located on said second constraining layer surface.

15. The structure of claim 12 wherein the viscoelastic glue is a fire enhanced glue comprising up to 25% of a zinc borate compound by weight.

* * * * *